US007791259B2

(12) United States Patent
Arndt et al.

(10) Patent No.: US 7,791,259 B2
(45) Date of Patent: Sep. 7, 2010

(54) UNCEMENTED SOCKETED LAMP

(75) Inventors: Joachim Arndt, Brieselang (DE); Uwe Fidler, Berlin (DE); Markus Herb, Gunzburg (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 364 days.

(21) Appl. No.: 11/883,526

(22) PCT Filed: Feb. 2, 2006

(86) PCT No.: PCT/DE2006/000162

§ 371 (c)(1),
(2), (4) Date: Aug. 1, 2007

(87) PCT Pub. No.: WO2006/081805

PCT Pub. Date: Aug. 10, 2006

(65) Prior Publication Data

US 2008/0164803 A1 Jul. 10, 2008

(30) Foreign Application Priority Data

Feb. 4, 2005 (DE) ..... 10 2005 005 265

(51) Int. Cl.
*H01J 5/48* (2006.01)
*H01J 5/50* (2006.01)

(52) U.S. Cl. ..... 313/318.1

(58) Field of Classification Search ..... 313/318.1
See application file for complete search history.

(56) References Cited

U.S. PATENT DOCUMENTS 4,464,600 A * 8/1984 Kosmatka et al. ..... 313/318.1
4,752,710 A * 6/1988 Devir et al. ..... 313/318.07
5,121,304 A 6/1992 Hall et al.
5,428,261 A 6/1995 Wittig et al.
5,453,656 A 9/1995 Ui

FOREIGN PATENT DOCUMENTS

| | | |
|---|---|---|
| DE | 37 04 502 | 9/1987 |
| DE | 41 20 833 | 6/1991 |
| DE | 43 17 252 | 5/1993 |
| DE | 195 12 407 | 4/1995 |
| EP | 231 936 | 2/1986 |
| EP | 0 381 269 | 8/1990 |
| EP | 0 639 849 | 2/1995 |
| EP | 1 109 199 | 12/1999 |

OTHER PUBLICATIONS textbook, Werkstoffem, Springerverlag, ISBN 3540573259.

* cited by examiner

*Primary Examiner*—Peter Macchiarolo

(57) ABSTRACT

A light bulb (1) with a base and inner vessel sealed in a vacuum-tight manner and surrounded by an enveloping part is provided with an adapter (13) at the end thereof made from ceramic polymer and fixed in a base insulator (12). The base insulator and the enveloping part are fastened to each other. The base insulator may be provided in pieces which fasten together and hold the adapter. The adapter allows cementless fastening of the inner bulb. The base insulator and the adapter part have matching indexing and mating indexing means for holding the base insulator and the adapter part in position relative to each other. Multiple mating indexing means on the base insulator allow the adapter to assume secure position at multiple heights relative to the base insulator.

12 Claims, 9 Drawing Sheets

UNCEMENTED SOCKETED LAMP

TECHNICAL FIELD

The invention is based on a lamp, in particular a high-pressure discharge lamp or incandescent lamp, comprising a base mounted without cement. Of particular relevance here are metal-halide lamps, high-pressure sodium lamps or halogen incandescent lamps having a pinch seal at one end and a ceramic base part, but also conventional incandescent lamps.

PRIOR ART

EP-A 1 009 013 and the prior art cited therein have disclosed a lamp in which the base consists of a conventional ceramic material. Such a base needs to be connected to the bulb either by means of cement or by means of a separate element producing the connection, such as a metal spring, for example. In addition, the poor workability of the conventional ceramic materials results in complex fastening and insertion of electrical parts of the base. In particular, fastening of the contact elements and possible installation of a fuse can only be implemented very laboriously. In addition, in the case of the use of base cement, the amount of time taken is very considerable owing to the baking that is required.

DE-C1 43 17 252 has already disclosed a lamp comprising a base mounted without cement which comprises three bulbs. It has a ceramic adapter, which is fitted to a screw-type base. Atmospheric pressure prevails between the envelope and the outer bulb.

DESCRIPTION OF THE INVENTION

The object of the present invention is to provide a lamp which can be produced easily and quickly and nevertheless withstands high loads. A further object is to provide a lamp comprising a base mounted at one end which is simple to fit and can be produced in a manner which can easily be automated.

This object is achieved by the invention as herein described. Particularly advantageous configurations are also described.

The invention makes it possible in a simple manner to fix the inner vessel of a lamp held at one end by means of a holding apparatus, which is in the form of an adapter, whose holding function is realized without base cement. The lamp is therefore particularly suitable for simple mechanical and automated manufacture on production lines without hot processes such as fuse-sealing, welding or soldering, for example. In addition, long process times, for example for drying, baking or pumping, are avoided. The inner vessel is fixed without the use of cement by means of an adapter part consisting of ceramic, in particular of polymer-ceramic. The material as described in DE-A 195 12 407 or else DE 41 20 833, for example, is suitable as the polymer-ceramic.

The inner vessel rests with an end section, usually a pinch seal or else a fuse seal, in the adapter part, where it is held, for example, by means of an interlocking connection. However, in this case the inner vessel may perfectly well have a second end section in the sense of an axially arranged tubular lamp, as are often used in motor vehicle headlamps. The lamp is often a discharge lamp or a halogen incandescent lamp.

In principle, the lamp according to the invention has an enveloping part, in particular an overlapping bulb. This bulb is often manufactured from quartz glass or hard glass. The term enveloping part should be understood here expressly also in the broader sense, for example in the sense of a reflector dome of a reflector lamp. Often, the inner vessel, often referred to here as the basic lamp, is the only bulb of a discharge lamp or incandescent lamp, but this bulb may possibly be provided with an additional outer bulb. The enveloping part generally has one or two ends. However, this function is not relevant in the context according to the invention. It is merely of interest that one end acts as an anchor part for fastening the base. In addition, one or two power supply lines are passed to the outside through the enveloping part at this end. According to the invention, the adapter is manufactured from a material which withstands high temperatures, in particular from plastic or from ceramic, in particular polymer-ceramic.

The term polymer-ceramic means a ceramic consisting of a material which is also referred to as a polymer-ceramic composite material or polymer matrix composite material or polymer-ceramic composite.

In general, the power supply lines are passed out downwards at the adapter. The adapter, which is shaped in the form of a "U", surrounds with two limbs a central part in the region of the broad sides of the pinch seal and also has a bottom part connecting the limb parts.

In principle, the adapter can be produced in advance as a component part. Particularly preferably, the inner vessel including the power supply lines protruding from it are manufactured in advance and only then is the adapter material applied to the power supply lines as an injection-molding compound, the compound being injection-molded around the power supply lines.

The material of the adapter is preferably a polymer-ceramic, in particular a composite material. In this case, the composite material may be inorganic, organic or a mixture of organic and inorganic components.

Such materials are known per se, for example from the literature such as the textbook *Werkstoffe* [Materials], Springerverlag, ISBN 3540573259. Known materials are, for example, carbide and nitride materials of inorganic polymers. The thermal stability of silicon carbonitride ceramics is very high.

The production of the lamp takes place in principle using the following process steps:

a) producing a basic lamp as known per se and providing a multi-part base insulator, for example comprising two or four similar parts, and an enveloping part having at least one opening at a neck part, which opening is equipped with a pretreated edge region; the pretreatment relates to the edge which is designed such that it maintains an outwardly protruding holder; the deformation is designed such that the outer diameter is greater than that of the neck region of the enveloping part;

b) attaching an adapter with indexing at one end of the basic lamp; the basic lamp may have one or two ends; in each case the adapter is attached to the end pointing towards the base by the two limbs of the adapter which are connected at their ends by means of a bottom part surrounding the end of the inner vessel; the end can thus already be fixed permanently—this applies in particular to injection-molding encapsulation—or can be positioned such that it is only loosely clamped between the limbs;

c) fixing the enveloping part and the modular unit comprising the adapter and the basic lamp in relation to one another and attaching and joining the parts of the base insulator; this can take place with or without the action of a spring; in the case of the action of a spring, in particular tongues on the inner wall of the collar parts of the base insulator can press onto the limbs of the adapter, as a result of which, under some circumstances, first of all fixing of the end of the basic lamp in the adapter is brought about; conversely, the tongue can naturally also be arranged on the outside on the limb part of the adapter, which represents a reversal of the relative forces of action;

d) connecting the parts of the base insulator, in particular by means of ultrasound welding or else high-frequency welding or else by means of an interlocking connection, as are each known per se in principle, and attaching the base contacts to the finished base insulator.

The process for producing the lamp is based in particular on the current principles of processing polymer-derived ceramics. One decisive advantage is their potentially simple processing in terms of plastics technology so as to form complex molded parts by means of extruding or injection-molding polymeric compounds and by means of cold-processing polymeric molded parts. Subsequent thermolysis yields the ceramic component part. The volume shrinkage associated with the conversion of the polymer to the ceramic can be set in a targeted manner by adding active or inactive fillers. Special mention should be made of the excellent stability at high temperatures of amorphous Si(B)CN compositions. They are characterized by a high resistance to oxidation and a high creep resistance; crystallization takes place only above from 1400. degree. C. to 1600. degree. C. The polymer-ceramic transformation plays a decisive role in the above-mentioned process for producing novel ceramic materials. Furthermore, the thermal stability of the carbonitrides produced is advantageous in terms of decomposition and corrosion. The manufacture can therefore be considerably simplified.

In a particularly preferred embodiment, the adapter is injection-molded directly to the inner vessel. In this case, the material of the adapter needs to be matched carefully to the material of the inner vessel, for example in terms of adhesiveness and the coefficient of thermal expansion. In this embodiment, an additional component part such as, for example, a spring element or base cement, is not required. The inner vessel and the adapter are automatically always centered with respect to one another owing to the production. The number of manufacturing steps is markedly reduced, and the heat dissipation during operation of the lamp is improved in comparison with a conventional ceramic. The automization is simplified in every respect.

On the one hand, thermoplastic injection-molding compound can generally be used in the production process. Typical examples of this class of materials are PEEK (polyether ether ketone), PPS (polyphenylene sulfide) or PPO (polyphenylene oxide). Polyamide can also be used. Another technique is the use of thermosetting transfer-molding compounds of organic or inorganic compositions. A typical example is Bakelite. In particular phenol resins or epoxy resins are used here. A specific material example is Cermosil 300 by HITK.

A further embodiment of the base insulator, which in particular comprises two half-shells, uses plastic. In contrast to a base insulator consisting of ceramic, in this case an additional snap-action connection is usually used which fixes a) the outer bulb and b) the basic lamp receptacle in the base insulator and therefore does not require any additional joining element such as an aluminum ring for the base insulator. A further possibility for joining the half-shells may also be an ultrasound connection between the plastic half-shells. At the same time, in this solution a metal spring for fixing the basic lamp in the adapter is not required, but instead it is now possible to connect the adapter, by means of an injection-molding process, directly and cohesively to the basic lamp itself. The basic lamp is also inserted into the injection mold itself, and the plastic or the ceramic is injected directly round the lamp.

A further possibility is to plug the basic lamp with a pinch seal with tight tolerances into a shaft of the adapter, which shaft has tight tolerances, without an intermediate element. For this purpose, however, greater value needs to be placed on the dimensional accuracy of the individual parts.

Preferred is the possibility of working with a so-called injection-molding ceramic, which withstands temperatures of up to 600° C., since 320° C. is still measured at the pinch seal of the lamp. In the case of low-wattage lamps, however, a PEEK may be sufficient. In particular, PEEK is very suitable as the material for the half-shells, but the plastic of the adapter should in this case withstand as high temperatures as possible.

Specifically, the present invention is concerned with an electric lamp, in particular a high-pressure discharge lamp, comprising a base mounted at one end and having an axis and an inner vessel which is sealed in a vacuum-tight manner, said inner vessel being surrounded by an enveloping part, a base with electrical terminals bearing the inner vessel, on the one hand, and the enveloping part, on the other hand.

The base has a base insulator which is produced from an insulating material and has a central opening with a surrounding collar, in which the inner vessel is accommodated by means of a cementless fastening means. The base insulator has a fastening means for the enveloping part. The enveloping part has, at the base end, an opening, a means for fastening it to the base insulator being located in the vicinity of the opening. The enveloping part is fastened to the base insulator by means of a cementless mechanical holding mechanism incorporating the abovementioned means. The cementless fastening means is an adapter part, which consists of polymer-ceramic.

Advantageously, the base insulator comprises at least two, preferably up to four, parts, which are in particular welded to one another by means of ultrasound. In this way, the base insulator can surround and hold the adapter in a simple manner.

In order to fasten the adapter in the base insulator, mechanical means are used. Preferably, the adapter part has a radially acting indexing, in particular a radially protruding projection, in the vicinity of its end which is remote from the inner vessel, which indexing interacts in holding fashion with at least one mating indexing interacting therewith, in particular a cutout of the collar in the interior of the central opening.

A particularly favorable feature of this basic design is the fact that it is possible to arrange a plurality of identical mating indexings, in particular cutouts, of the collar along the axis (A), with the result that the indexing, in particular the projection, can be inserted in the collar with differing physical depth.

Specifically, the indexing can be in the form of a groove, sickle, tooth, peripheral web or peripheral groove. Preferably, the indexing is attached to the bottom part of the adapter, but it may also be positioned slightly higher laterally on the limb parts. However, it should not be attached higher than 30% of the axial length from the end of the adapter, in order to ensure a secure fit of the inner vessel.

In general, the mating indexing needs to have the matching mating shape to the indexing, at least in outline. In this case, at least the contours fit together, for example a projection fits with a cutout.

In particular, the adapter is produced from one of the following materials: a composite material or a thermoplastic or thermosetting plastic. In this case, a composite material is to be understood in such a way that it is either inorganic, organic or a mixture.

Advantageously, the base insulator consists of a high-temperature plastic. A specific example is ULTRASON®, for example type 2010, by BASF, which is a PESU, i.e. a polysulfone or polyether sulfone.

The connection between the adapter and the inner vessel is alternatively such that the adapter is fastened in clamping fashion to the end of the inner vessel, in particular with spring clamps. An alternative is for the limb parts of the adapter to be pressed slightly inwards when the base insulator is joined, indirectly by means of force transfer means, for example tongues, which protrude radially, and therefore ultimately to bring about the clamping effect. However, this requires a material with a spring action for the adapter.

The present concept is suitable in particular for a modular lamp construction for outer bulb and reflector lamps. In addition, for operation in open and closed luminaires, it is suitable for simple, mechanical, automated manufacture on production lines without hot processes (fuse-sealing, welding, soldering) and without long process times (drying, baking, pumping).

A particular advantage is the fact that different light centers can be set by means of a suitable adapter system. Owing to the low manufacturing tolerance, for example in the case of an injection-molding production, the inner vessel can be inserted into the adapter in directly clamping fashion, i.e. without a spring part.

In order to make it possible to accommodate the adapter in the base insulator, which is preferably produced from high-temperature plastic, it should be manufactured in a plurality of parts, and at least in two parts. This circumstance also advantageously makes it possible to fasten (for example by means of clamping) an enveloping part on the base insulator in a simple manner. In this case, it may be favorable for a spring action to provide slits in the enveloping part. In the case of the use of high-temperature plastic parts for the base insulator, these parts can be welded by means of ultrasound welding.

A basic lamp body, often referred to as the inner vessel, which, owing to the modular design of the lamps, is often a mass-produced product, for example a ceramic discharge vessel for a metal-halide lamp with an outer bulb, is inserted, via the pinch seal or fuse seal of the outer bulb, into the ceramic lamp adapter, preferably consisting of polymer-ceramic, preferably produced in an injection-molding process.

FIGURES

The invention will be explained in more detail below with reference to a plurality of exemplary embodiments. In the drawings:

FIG. 1 shows a metal-halide lamp in a side view (FIG. 1*a*) and enlarged in details, in particular of the edge region of the enveloping part once a holding means has been produced (FIGS. 1*b, c, d*);

FIG. 2 shows an adapter part in a perspective view (2*a*), in section (2*b*) and in an oblique view from below (2*c*) as well as a further exemplary embodiment of an adapter in section (2*d*);

FIG. 3 shows one half of the base insulator from FIG. 1 prior to it being assembled in a perspective view (3*a*), in a side view (3*b*) and in a side view rotated through 90° (3*c*);

FIG. 4 shows a detail of the edge region of the enveloping part for another exemplary embodiment;

FIG. 5 shows a further exemplary embodiment of a base insulator in a perspective view once the two halves (5*a*) have been welded as well as a detail of the enveloping part (5*b*);

FIG. 6 shows a further exemplary embodiment of one half of a base insulator in a perspective view (6*a*) and shown from above (6*b*);

FIG. 7 shows a further exemplary embodiment of a base insulator after assembly from above (7*a*) and from below (7*b*) as well as in section (7*c*);

FIG. 8 shows a further exemplary embodiment of a reflector lamp in section.

DESCRIPTION OF THE DRAWINGS

An exemplary embodiment of a metal-halide lamp 1 is shown in a side view in FIG. 1*a* and as various details (FIGS. 1*b*, 1*c*, 1*d*). A ceramic discharge vessel 2, which is sealed at two ends, is arranged extending longitudinally in the lamp axis A. It is tightly surrounded by an outer bulb 3, which is pinch-sealed at one end and is manufactured from hard glass or quartz glass. A frame 4 with a short and a long feed line 5, 6 holds the discharge vessel 2 in the outer bulb 3. The electrodes 7 in the interior of the discharge vessel are connected to the feed lines 5, 6 via leadthroughs 8. Said feed lines 5, 6 are connected to external power supply lines 10 in the region of a pinch seal 9, which seals the outer bulb 3. The outer bulb and the discharge vessel together form the inner vessel, also referred to as the basic lamp. The pinch seal 9 of the outer bulb rests over a cavity 11 of an adapter 13 consisting of polymer-ceramic. The adapter 13 is held in a base insulator 12 consisting of a plastic which can be subjected to a high load, in particular high-temperature plastic, or else a conventional ceramic material such as steatite.

The adapter 13 (see FIG. 2) is roughly speaking a rectangular parallelepiped, which tapers slightly conically upwards and has two limb parts 14 with an opening 15 inbetween. The opening 15 is matched loosely to the pinch seal 9 of the outer bulb 3. The pinch seal 9 is held in the adapter by means of a spring part 35, as is known per se.

Figure 1A:
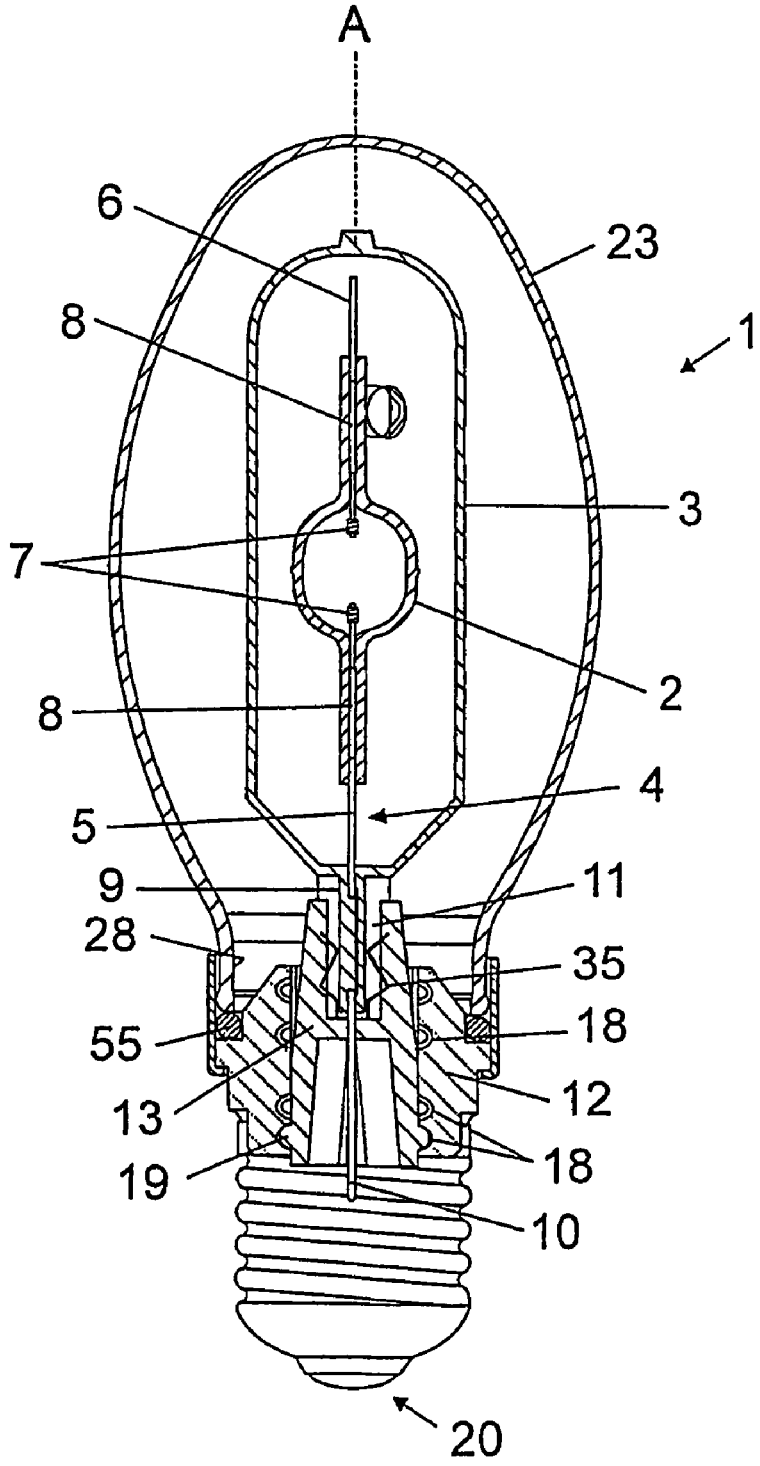
Figure 1B:
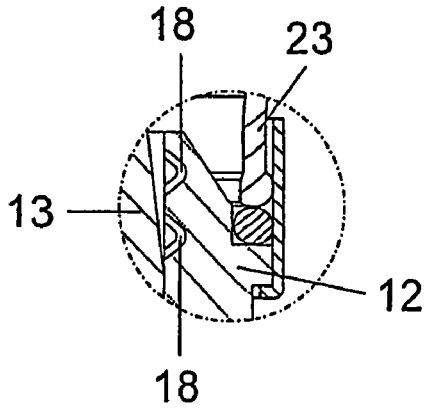
Figure 1C:
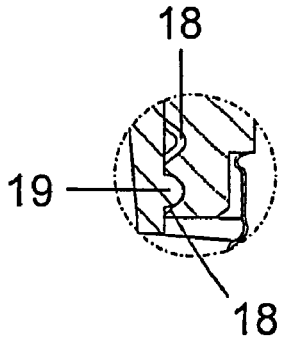
Figure 1D:
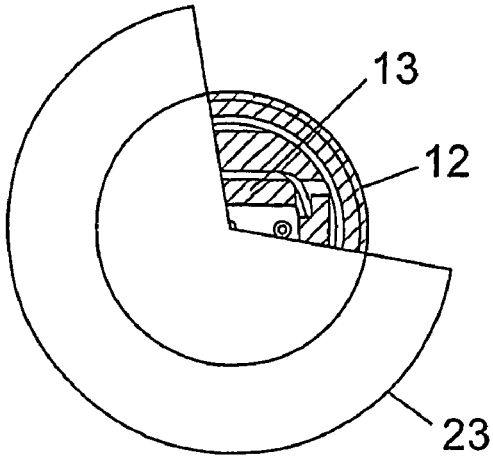

The limb parts 14 are connected to one another at their bottom via a bottom part 16, with the result that the adapter is in this regard in principle in the form of a U. An exemplary embodiment of the adapter 13' in accordance with this principle alone is shown in FIG. 2*d*. It has only the limb 14' and the bottom part 16'. At the foot of the bottom part 16', which is circular-cylindrical, a radial projection 17 runs around the periphery, whose height makes up approximately 10 to 15% of the width of the bottom part without the projection. This projection, which is triangular (2*d*) or hemispherical (2*a*) in cross section, is the specific indexing for anchoring purposes in the base insulator 12.

Figure 2A:
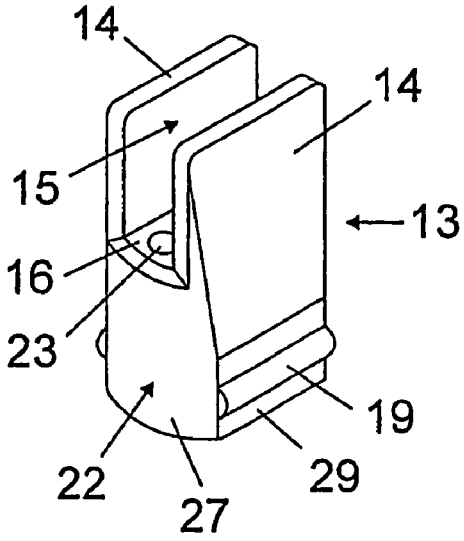
Figure 2B:
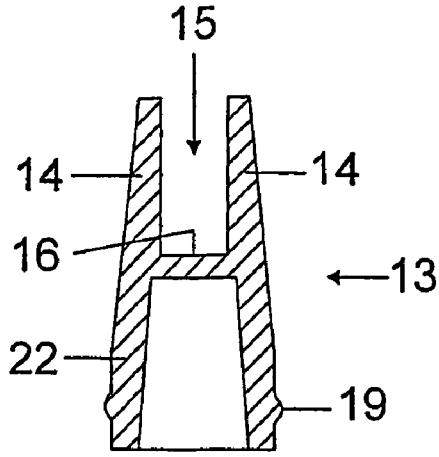
Figure 2C:
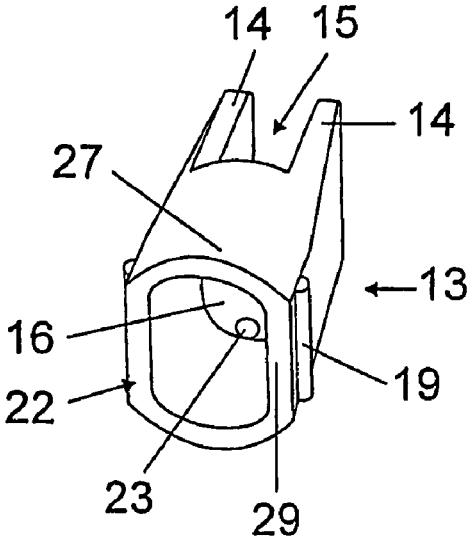
Figure 2D:
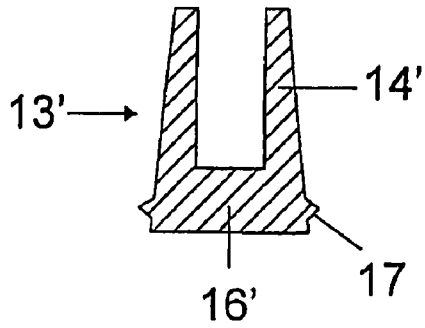

In the exemplary embodiment in FIGS. 2*a* to 2*c*, a hollow-cylindrical part 22 is placed on the bottom part 16 so as to protrude downwards. The bottom part has one or two apertures 23 for the power supply lines 10. In this case, the indexing is a bead 19, which extends outwards transversely at two side walls of the hollow cylinder. In cross section, the hollow cylinder is a rounded-off rectangle with two straight side walls 29 and two bent side walls 27.

Figure 3A:
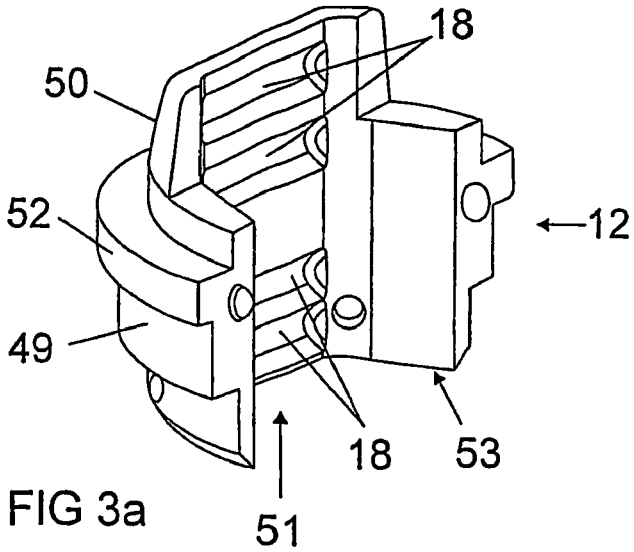
Figure 3B:
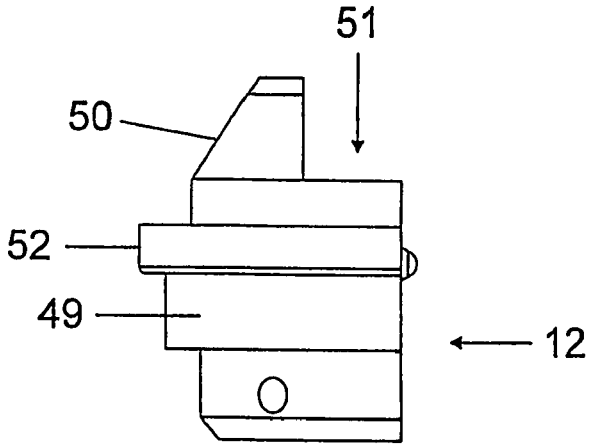
Figure 3C:
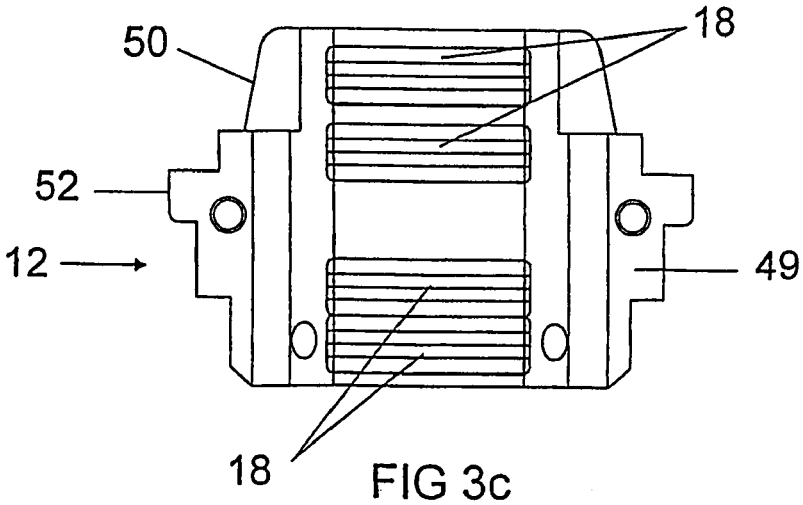

The base insulator 12 (FIGS. 1 and 3) has a hollow-cylindrical basic body 49, which comprises two halves (FIG. 3 shows one half). It comprises a wall 53 and a cavity 51. Two collar parts 50, which to a certain extent extend the cavity 51 upwards, rest on the basic body 49. A peripheral molding 52 is placed on the outside on the basic body 49. It acts as a stop for the envelope, it being possible for an elastic ring 55 to be inserted inbetween. The base insulator has matching cutouts 18 on the inner wall of its collar parts 50, in this case a channel, which, as mating indexing, interacts with the indexing of the adapter part, the bead 19.

The particular feature of the base insulator in the preferred embodiment shown is the fact that it has a plurality of channels 18 arranged axially one above the other. In total four channels 18 are shown in FIG. 1 which are arranged parallel one above the other and make it possible, in principle, to move the light center correspondingly deeper if the bead 19 is fitted into another, deeper channel 18 instead of the highest channel 18. In this case, it is recommended to provide the adapter 13 possibly with an extension cylinder 22 (FIG. 2*b*) in order that the adapter can be fitted easily into the lowermost channel 18 and therefore has a long guide in the base insulator.

Figure 5A:
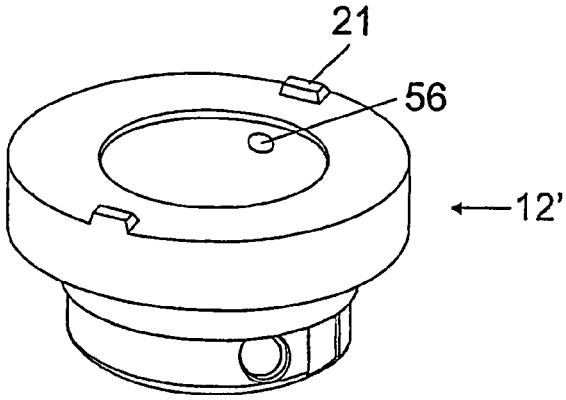

The adapter 13 is fitted into the base insulator 12 (as shown in FIG. 1) by virtue of the fact that the base insulator (FIG. 3) comprises two substantially identical halves 12, which are positioned onto the adapter 13 from the side such that the bead 19 fits into one of the cutouts 18 and then are welded by means of ultrasound or else high-frequency welding, as is known per se. For example, the HF process is described in DE-A 36 03 753. For this purpose, the halves have, under some circumstances, initially or permanently fitting means. In particular, a conductive, in particular ferromagnetic metal strip or carbon strip is suitable as the means. A mechanical interlocking connection is also possible. One example of a finished base insulator 12' is shown in FIG. 5*a*.

By selecting the opening width of the insertion shaft 15 of the adapter and the design of the limb parts 14 to be suitably narrow, the basic lamp is alternatively clamped directly by means of the pinch seal 9, which prevents the basic lamp from sliding out owing to the tight tolerance. In this case, a spring element is no longer required.

Alternatively, the base insulator may have inwardly protruding buttons 56 on its upper edge of the opening, which buttons press the upper free end of the collar part 14 inwards and therefore fix the pinch seal of the basic lamp in clamping fashion. In this case, the adapter 13 itself to consists of plastic and permits a certain spring action of the limb parts 14.

The base insulator 12 may be designed to have a plurality of parts, preferably two parts and at most four parts. The design of the base insulator with a plurality of parts also permits simple accommodation of an enveloping part, see FIG. 4, preferably of an overlapping bulb 23 consisting of glass, in the case of reflector lamps advantageously a contour of a reflector. The base insulator 12 also serves the purpose of holding a base contact 20, preferably a metal screw-type base, for example E27, see FIG. 1, or the lower part of the base insulator is itself in the form of a base contact.

A two-part adapter, preferably consisting of polymer-ceramic, is in principle also possible.

A separately manufactured adapter has the advantage that, owing to suitable dimensions of the lamp adapter, different light centers can be set without needing to change the base insulator. Given a design of the base insulator with a plurality of parts, the lamp adapter and the enveloping part are inserted into one half of the base insulator. The second half of the base insulator is then joined and connected to the first half by means of a suitable connection technique, for example ultrasound welding.

If different light centers are desired, the lamp adapter is given an indexing, preferably a bead, or button or a groove, sickle, tooth or the like or a peripheral web or a peripheral groove at a certain height. In this case, the base insulator is provided with a plurality of mating indexings required for different light centers, for example rows of grooves, sickles or webs. Owing to a corresponding insertion height during fitting, the desired light center is thus set.

In a preferred embodiment, the opening edge of the enveloping part is designed such that it is prevented from being twisted or withdrawn. The protection against twisting is ensured, for example, by one or more sickles, grooves or the like being introduced on the enveloping part which interact with bulges 21 on the base insulator 12', see FIG. 5*a*.

Figure 4:
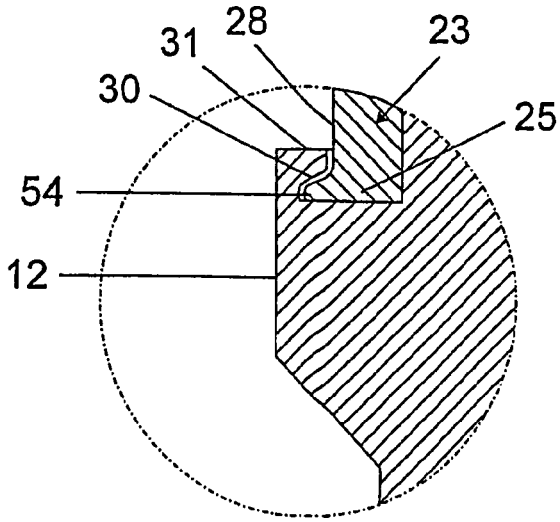
Figure 5B:
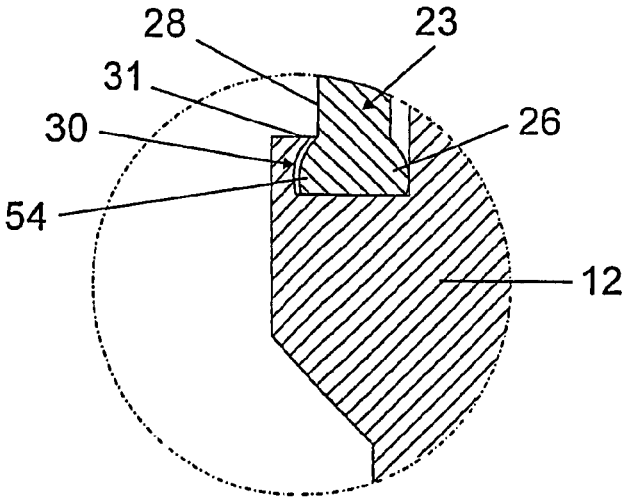

The enveloping part 23 is prevented from falling out of or being withdrawn from the base insulator 12 by a shoe-shaped enlarged portion 24 at the opening edge of the enveloping part, for example the enlarged portion is provided at the opening by means of the edge region 25 of the enveloping part being beveled in the vicinity of the opening towards the outside (up to 90°) or by means of flame-rounding, which can form a bud 26 on the edge region 25 of the enveloping part, see FIGS. 4 and 5*b*. The enveloping part 23 may in particular have a straight neck 28 as an attachment in the region of its opening, see FIG. 1. In this case, care needs to be taken when flame-rounding that the edge is deformed in such a way that its outer diameter is larger than the diameter of the neck.

The base insulator 12 advantageously has a peripheral channel 30 on its surface which points towards the enveloping part 23, which channel 30 runs in the vicinity of the outer edge (FIGS. 4 and 5*b*). The outer edge of the channel 30 is provided partially with a roof 31 (FIG. 5*b*), which still leaves sufficient space in the channel for the wall of the neck 28. As a result of the fact that the base insulator comprises at least two parts, the protrusion 54 of the enveloping part 23 can be grasped from behind in a simple manner by the roof 31 of the channel 30, as a result of which the enveloping part 23 is locked against the base insulator 12.

The electrical contact (FIG. 1) between the lamp power supply lines 10 and the base contacts 20 of the screw-type base is produced by means of power supply line extensions consisting of a suitable conductor material. The connections can be produced by means of welding, deformation or clamping, as is known per se.

When correspondingly shaping the injection-molded high-temperature plastic or polymer-ceramic parts, given a multi-part design of the base insulator 12, metallic contact parts, for example insulation displacement or clamping connections, can be inserted into the opening 51 of the base insulator or into the opening 15 of the lamp adapter 13 before it is closed and welded.

These clamping connections are then prefabricated with correspondingly long power supply line extensions. The base contact 20 is fixed mechanically on the base insulator 12 by means of deformation, for example crimping, as is known per se, or the adapter receptacle itself forms the base.

Protection against electric shock for the base system is ensured in an ideal extremely simple manner by the adapter 13' surrounding the pinch seal of the outer bulb by being injection-molded around it (FIG. 8), which until now has not been possible since the base system until now has necessarily been manufactured separately and therefore in any case needed to have an opening for accommodating the bulb. Accordingly, a safe distance needed to be maintained which is now no longer necessary, however, with the result that the lamp can be designed overall to be more compact.

FIG. 5*a* shows an embodiment of the base insulator 12' in which an anti-rotation part is in the form of a bulge 21. This bulge 21 is, so to speak, the positive to a negative attached to the edge of the neck of the enveloping part.

For production purposes, in particular a modular unit comprising the basic lamp which is finished per se is provided whose power supply lines 3 are particularly long in comparison with the conventional technology or are already connected to the contact pins 4. This takes place, for example, by means of crimping or welding. For the connection to the adapter, the basic lamp is provided with a provisional holder. This then acts as an adjustment aid and stop for the injection-molding die into which the precursor material of the adapter is introduced.

Figure 6A:
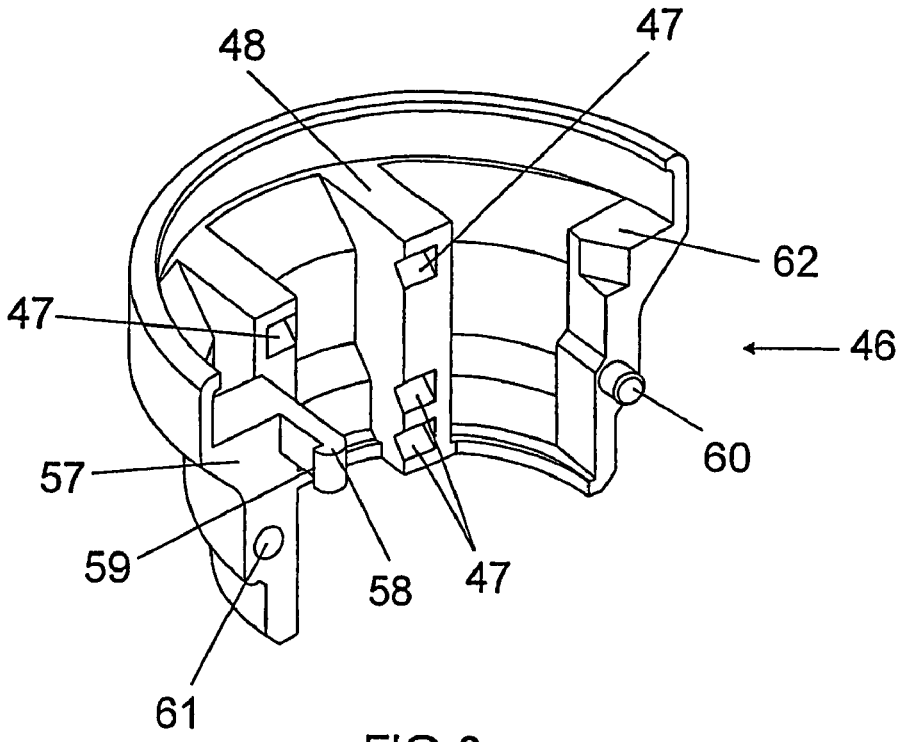
Figure 6B:
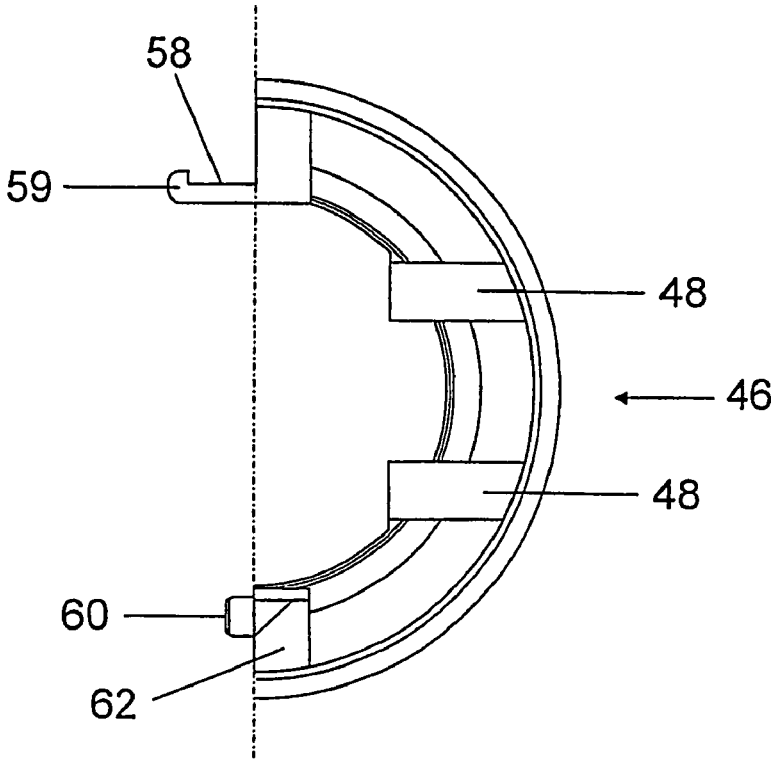

FIG. 6 shows a half-shell 46 of a base insulator consisting of plastic such as Ultrason 2010 or PEEK. In this case, the mating indexings are formed as channels 47 (three rows) in the form of a triangle at posts 48. For the purely mechanical interlocking connection, each half-shell 46 has a catch 58, which protrudes tangentially inwards at the upper edge of the wall 57 of the opening, having a hook 59 and a guide pin 60, which protrudes approximately at half the height at the other end of the semicircle transversely with respect to the axis and is inserted into a matching hole 61 in the other half-shell. The catch 58 latches with its hook 59 undetachably into an offset portion of the other half-shell and itself provides such an offset portion 62 for the catch of the other half-shell.

Figure 7A:
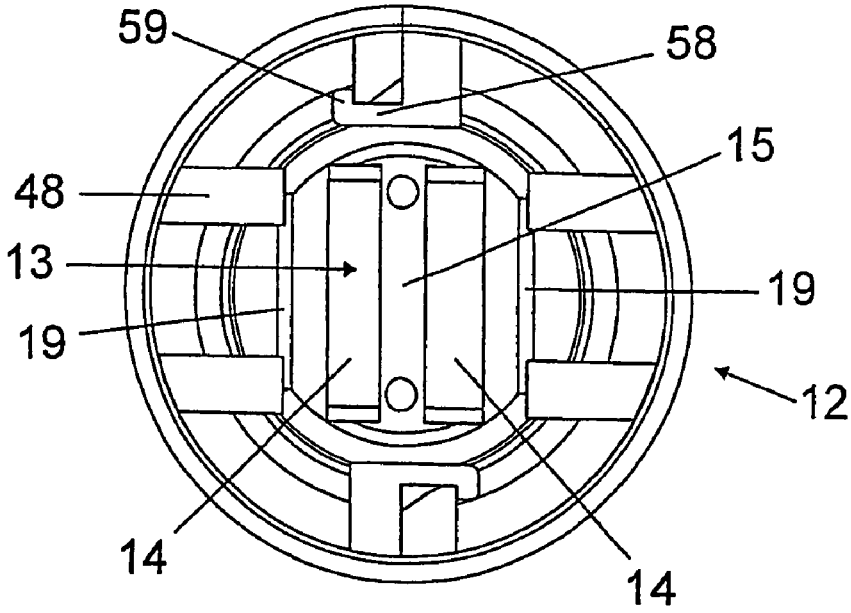
Figure 7B:
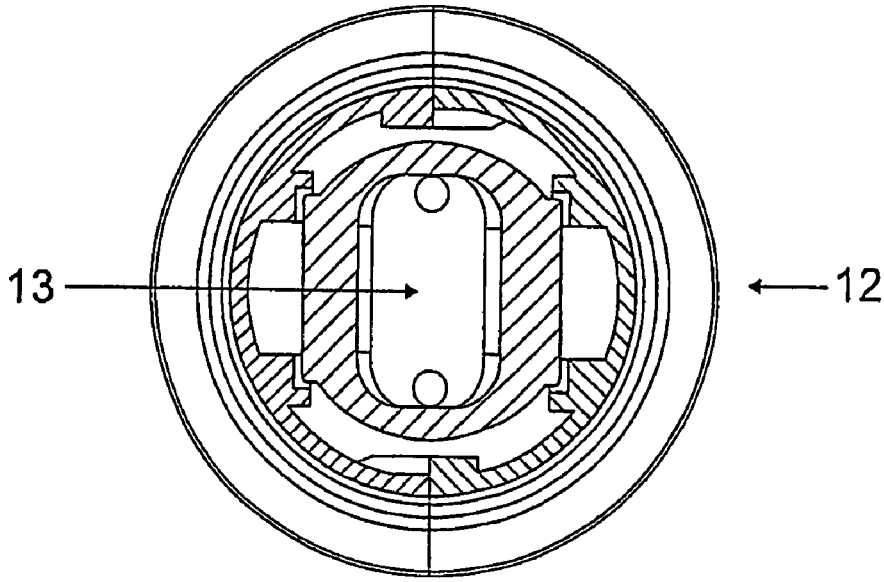
Figure 7C:
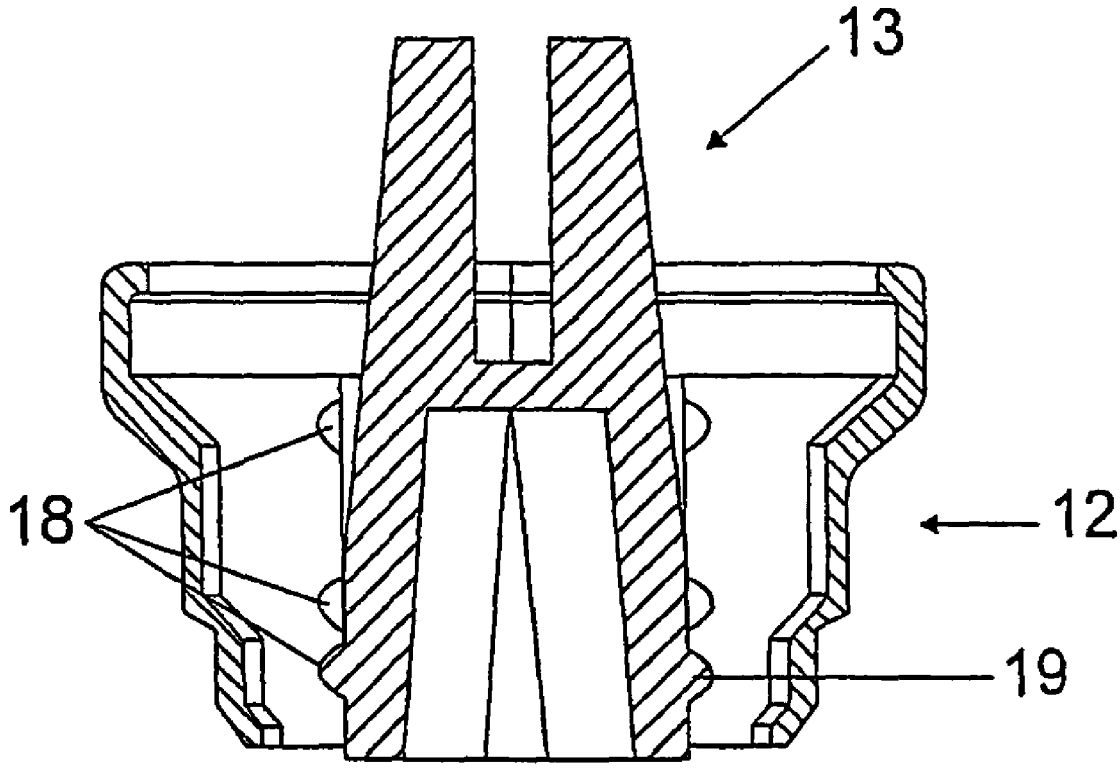

FIG. 7 shows the base insulator comprising two halves as shown in FIG. 6, in a plan view and a view from below, with the adapter 13 installed. In this case, the adapter 13 is fixed at its two beads 19 by the in total four posts 48 with their channels 18.

Figure 8:
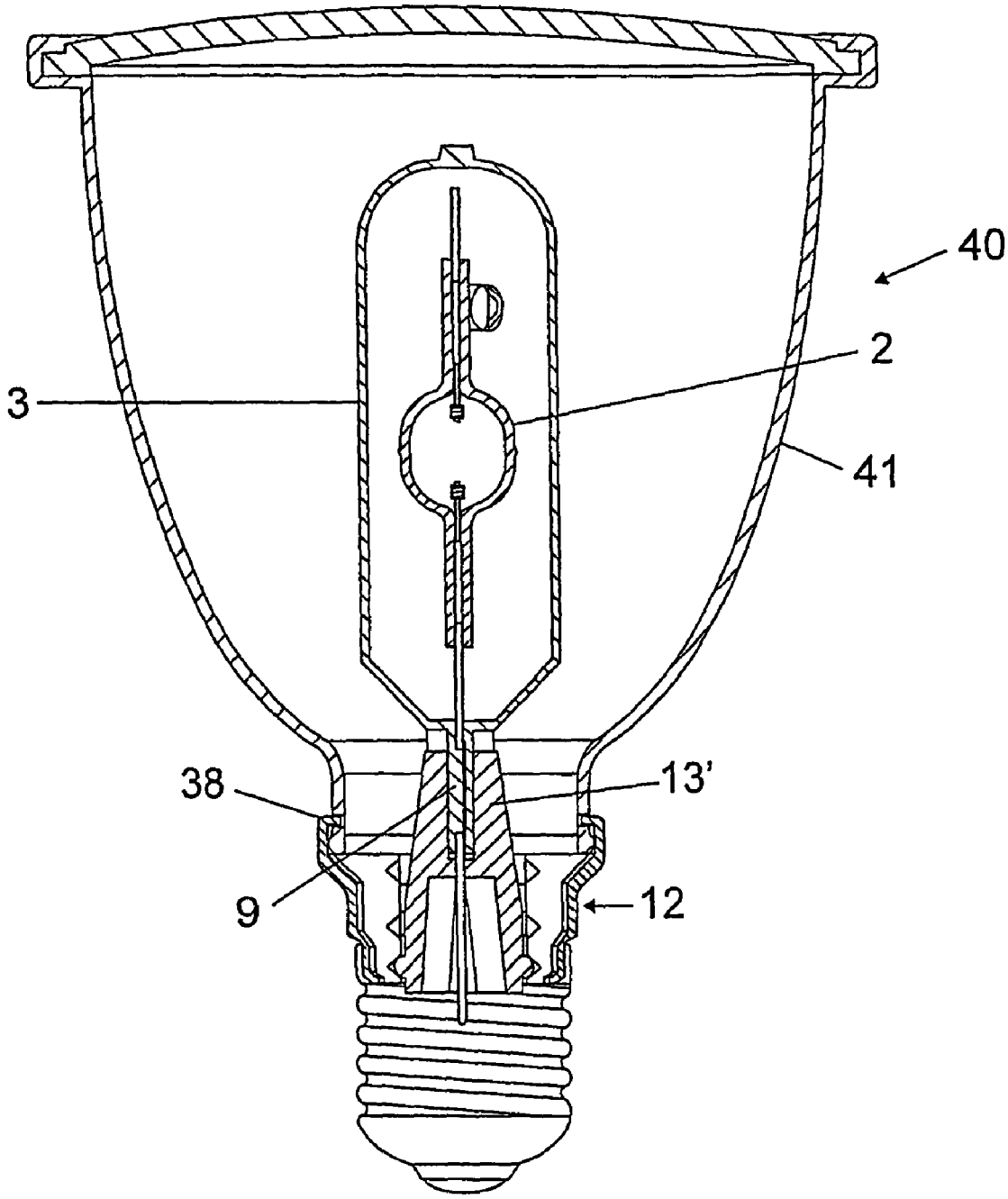

FIG. 8 shows a reflector lamp 40 having a reflector part 41 as the enveloping part. FIG. 8 shows a side view, in section, the adapter 13' consisting of polymer-ceramic being injection-molded directly around the pinch seal 9 of the outer bulb 3 and holding it without any further auxiliary means. The base insulator 12 is provided at its outer edge with a trimming 38 with a bent-back edge, which holds the enveloping part 41. In this case, the enveloping part is a reflector contour. Here, the contour of the reflector part 41 is manufactured from aluminum. The reflector part can also be fastened by means of crimping to the base insulator, as is known per se.

The invention claimed is:

1. An electric lamp comprising a base at one end and having an axis (A) and an inner vessel, the inner vessel sealed in a vacuum-tight manner, said inner vessel being surrounded by an enveloping part, and wherein the base comprises electrical terminals and bears the inner vessel and the enveloping part and wherein:

a) the base includes a base insulator comprising an insulating material, which base insulator has a central opening with a surrounding collar in which the inner vessel is accommodated by means of a cementless fastening means;

b) the base insulator has a first fastening means for the enveloping part;

c) the enveloping part has an opening at the base end and a second fastening means, located in the vicinity of the opening, for fastening it to the base insulator;

and further wherein the cementless fastening means is an adapter part comprising a ceramic material and further wherein the adapter part and the base insulator respectively have indexing means and mating indexing means for holding the base insulator and the adapter part in relative position, and wherein the indexing means has a radially protruding projection in the vicinity of the adapter's end remote from the inner vessel, wherein the projection interacts in a holding fashion with at least one mating indexing means, the mating indexing means being a cutout of the collar in the interior of the central opening of the base insulator, and wherein a plurality of identical mating indexing means are arranged in the central opening along the axis (A), such that the adapter is capable of being inserted into the collar of the base insulator with differing physical depth.

2. The lamp as claimed in claim 1, wherein the base insulator consists of a plastic which withstands high temperatures.

3. The lamp as claimed in claim 2, wherein the base insulator comprises at least two parts which are either welded to one another by means of ultrasound or high-frequency welding or are connected to one another in interlocking fashion by latching elements.

4. The lamp as claimed in claim 1, wherein the inner vessel is inserted in the adapter part and is directly clamped by the adapter part.

5. The lamp as claimed in claim 1, wherein the indexing means is in the form of a groove, sickle, tooth, peripheral web or peripheral groove.

6. The lamp as claimed in claim 5, wherein the mating indexing means has the corresponding mating shape to the indexing means.

7. The lamp as claimed in claim 1, wherein the adapter part is produced from one of the following materials: a composite material or a thermoplastic or thermosetting plastic.

8. The lamp as claimed in claim 7, wherein the composite material is inorganic, organic or a mixture.

9. The lamp as claimed in claim 1, wherein the adapter part is in the form of a U, comprising two limbs, which surround the end of the inner vessel, and a bottom part, which connects the limbs.

10. The lamp as claimed in claim 1, wherein the adapter part is fastened directly to the inner vessel.

11. The lamp as claimed in claim 1, wherein the enveloping part is an outer envelope or a reflector part.

12. The lamp as claimed in claim 1, wherein the adapter part comprises polymer-ceramic.

* * * * *